US010275985B2

(12) United States Patent
Froy

(10) Patent No.: US 10,275,985 B2
(45) Date of Patent: Apr. 30, 2019

(54) ENHANCED ELECTRONIC GAMING MACHINE WITH GAZE-BASED DYNAMIC ADVERTISING

(71) Applicant: IGT CANADA SOLUTIONS ULC, Moncton (CA)

(72) Inventor: David Froy, Lakeville-Westmorland (CA)

(73) Assignee: IGT CANADA SOLUTIONS ULC, Moncton (CA)

( * ) Notice: Subject to any disclaimer, the term of this patent is extended or adjusted under 35 U.S.C. 154(b) by 18 days.

(21) Appl. No.: 14/966,787

(22) Filed: Dec. 11, 2015

(65) Prior Publication Data

US 2017/0169663 A1 Jun. 15, 2017

(51) Int. Cl.
*G07F 17/32* (2006.01)

(52) U.S. Cl.
CPC ..... *G07F 17/3255* (2013.01); *G07F 17/3204* (2013.01); *G07F 17/3209* (2013.01); *G07F 17/3225* (2013.01); *G07F 17/3239* (2013.01); *G07F 17/3246* (2013.01)

(58) Field of Classification Search
CPC ..... G07F 17/34
See application file for complete search history.

(56) References Cited

U.S. PATENT DOCUMENTS 6,222,465 B1 4/2001 Kumar et al.
7,815,507 B2 10/2010 Parrott et al.
2006/0063587 A1* 3/2006 Manzo ..... G07F 17/32 463/25
2011/0111862 A1* 5/2011 Allen ..... G07F 17/32 463/42
2012/0108321 A1* 5/2012 Radek ..... G07F 17/3216 463/25
2012/0295708 A1* 11/2012 Hernandez-Abrego ..... A63F 13/424 463/36
2012/0309524 A1* 12/2012 Rajaraman ..... G07F 17/3206 463/31
2014/0195345 A1* 7/2014 Lyren ..... G06Q 30/0271 705/14.53
2014/0207559 A1* 7/2014 McCord ..... G06Q 30/0242 705/14.41
2014/0228119 A1* 8/2014 Koenig ..... A63F 13/52 463/32
2014/0274388 A1* 9/2014 Nguyen ..... G07F 17/3206 463/31
2015/0348358 A1* 12/2015 Comeau ..... G07F 17/34 463/20

* cited by examiner

*Primary Examiner* — Robert T Clarke, Jr.
(74) *Attorney, Agent, or Firm* — Sage Patent Group

(57) ABSTRACT

A computer device and method for dynamically displaying at least one advertisement to a player of a game are provided. The computer device may be an electronic gaming machine, and comprises a camera which can be used to collect data on the movement of a player of an electronic game. The movements of the player may then be analyzed and used to select an advertisement to present to the player based on player movement data. The player movement data may also be used to generate advertising preferences for the player, and may be compiled into an advertising profile. The advertising profile may then be shared with other advertisers.

14 Claims, 11 Drawing Sheets

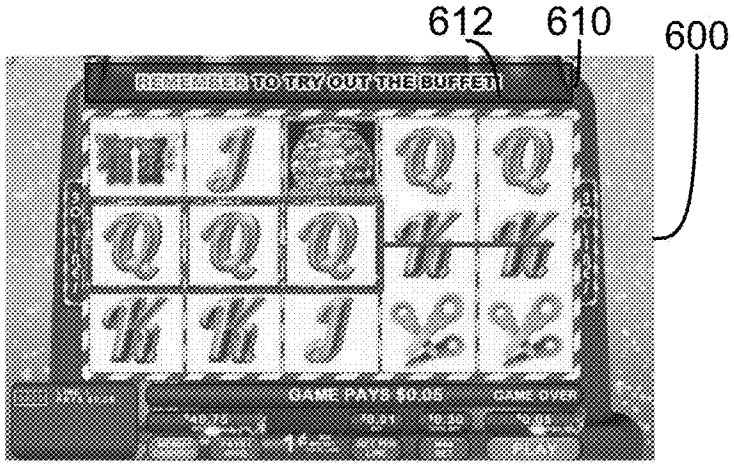
Figure 6A
Figure 6B
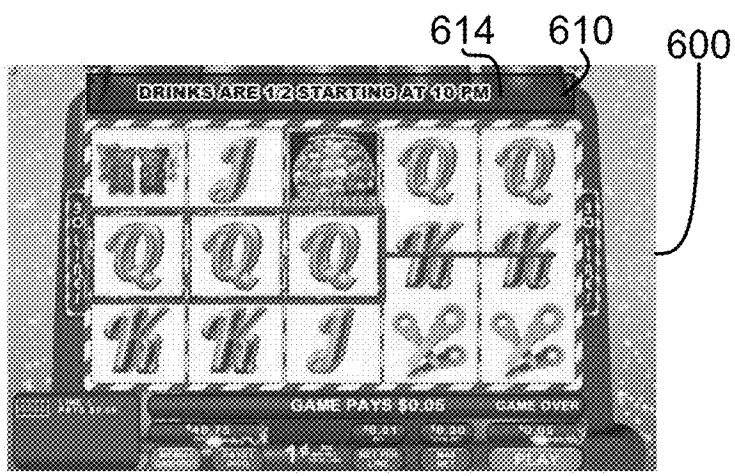
Figure 6C
Figure 6D

ENHANCED ELECTRONIC GAMING MACHINE WITH GAZE-BASED DYNAMIC ADVERTISING

TECHNICAL FIELD

The present application is generally drawn to electronic gaming systems, and more specifically to manipulating game components or interface in response to a player's body movements.

BACKGROUND OF THE ART

Many different video gaming systems or machines exist, and may consist of slot machines, online gaming systems (that enable players to play games using computer devices, whether desktop computers, laptops, tablet computers or smart phones), computer programs for use on a computer device (including desktop computer, laptops, tablet computers of smart phones), or gaming consoles that are connectable to a display such as a television or computer screen.

Video gaming machines may be configured to enable players to play a variety of different types of games. One type of game displays a plurality of moving arrangements of gaming elements (such as reels, and symbols on reels), and one or more winning combinations are displayed using a pattern of gaming elements in an arrangement of cells (or an "array"), where each cell may include a gaming element, and where gaming elements may define winning combinations (or a "winning pattern").

Games that are based on winning patterns may be referred to as "pattern games" in this disclosure.

One example of a pattern game is a game that includes spinning reels, where a player wagers on one or more lines, activates the game, and the spinning reels are stopped to show one or more patterns in an array. The game rules may define one or more winning patterns of gaming elements, and these winning patterns may be associated with credits, points or the equivalent.

Another example type of game may be a maze-type game where the player may navigate a virtual character through a maze for prizes.

A further example type of game may be a navigation-type game where a player may navigate a virtual character to attempt to avoid getting hit by some moving or stationary objects and try to contact other moving or stationary objects.

Gaming systems or machines of this type are popular, however, there is a need to compete for the attention of players by innovating with the technology used to implement the games.

SUMMARY

A computer device and method for dynamically displaying at least one advertisement to a player of a game are provided. The computer device may be an electronic gaming machine, and comprises a camera which can be used to collect data on the movement of a player of an electronic game. The movements of the player may then be analyzed and used to select an advertisement to present to the player based on player movement data. The player movement data may also be used to generate advertising preferences for the player, and may be compiled into an advertising profile. The advertising profile may then be shared with other advertisers.

In accordance with a broad aspect, embodiments described herein relate to computer-implemented devices, systems and methods for moving game components that may involve displaying game components using various three-dimensional enhancements. The gaming surface may be provided as a three-dimensional environment with various points of view. The devices, systems and method may involve tracking player movement and updating the three-dimensional point of view based on the tracked player movement. The devices, systems and method may involve tracking player movement and updating three-dimensional objects, virtual characters or avatars, gaming components, or other aspects of the gaming surface in response. For example, the devices, systems and method may involve tracking a player's eyes so that when the eyes move the virtual characters, gaming components, gaming surface, or other object moves in response. The player may navigate virtual characters through a game with body and eye movements. Tracking the player's may manipulate gaming objects based on body and eye movements. The player's movements may also relate to particular gestures.

In accordance with another broad aspect, the three-dimensional enhancement may involve displaying multi-faceted game components as a three-dimensional configuration. The devices, systems and method may involve tracking player movement, including eye movements, and rotating the multi-faceted game components in response to tracked movement. The rotation may be on different axis, such as vertical, horizontal or at an angle to a plane of the game surface or display device. The rotation may enable a player to view facets that may be hidden from a current view. The devices, systems and method may involve tracking player movement and updating the point of view of the three-dimensional enhancement multi-faceted game components in response.

In accordance with a further broad aspect, there is provided an electronic gaming machine. The electronic gaming machine comprises at least one data storage unit to store game data for a game played by a player and comprising wagering and payout elements; a display unit to display, via a graphical user interface, graphical game components including at least one advertisement in accordance with the game data; at least one data capture unit to collect player movement data representative of movement of at least one eye of the player, the data capture unit comprising a camera; and at least one processor. The processor is configured to analyze the player movement data to determine at least one advertising preference of the player; select, at least in part based on the advertising preference, a first of the at least one advertisement; and modify at least some of the graphical game components to display the first of the at least one advertisement.

In some embodiments, the at least one processor is further configured to cause the at least one advertising preference of the player to be stored in a database, the advertising preference being stored in association with an advertising profile of the player.

In some embodiments, the at least one processor is further configured for modifying the graphical game components of the first advertisement based on the at least one advertising preference of the player.

In accordance with a further broad aspect, there is provided a method for execution by an electronic gaming machine. The method comprises storing, in at least one data storage unit, game data for a game played by a player and comprising wagering and payout elements; displaying, via a graphical user interface, graphical game components including at least one advertisement in accordance with the game data; capturing, via at least one data capture unit, player movement data representative of movement of at least one eye of the player, the data capture device comprising a camera; and using at least one processor. The at least one processor is used for analyzing the player movement data to determine at least one advertising preference of the player; selecting, at least in part based on the advertising preference, a first of the at least one advertisement; and modifying at least some of the graphical game components to display the first of the at least one advertisement.

In some embodiments, the at least one processor is further used to cause the at least one advertising preference of the player to be stored in a database, the advertising preference being stored in association with an advertising profile of the player.

In some embodiments, the at least one processor is further used for modifying the graphical game components of the first advertisement based on the at least one advertising preference of the player.

In accordance with certain embodiments, there is provided a computer readable medium having stored thereon program code executable by at least one processor for performing any one or more of the methods described herein.

Features of the systems, devices, and methods described herein may be used in various combinations, and may also be used for the system and computer-readable storage medium in various combinations.

In this specification, the term "game component" or game element is intended to mean any individual element which when grouped with other elements will form a layout for a game. For example, in card games such as poker, blackjack, and gin rummy, the game components may be the cards that form the player's hand and/or the dealer's hand, and cards that are drawn to further advance the game. As a further example, in navigational games the game components may be moving or stationary objects to avoid or hit to achieve different game goals. In a maze game, the game components may be walls of the maze, objects within the maze, features of the maze, and so on. In a traditional Bingo game, the game components may be the numbers printed on a 5×5 matrix which the players must match against drawn numbers. The drawn numbers may also be game components. In a spinning reel game, each reel may be made up of one or more game components. Each game component may be represented by a symbol of a given image, number, shape, color, theme, etc. Like symbols are of a same image, number, shape, color, theme, etc. Other embodiments for game components will be readily understood by those skilled in the art.

BRIEF DESCRIPTION OF THE DRAWINGS

Further features and advantages of embodiments described herein may become apparent from the following detailed description, taken in combination with the appended drawings, in which:

FIGS. 6A-D are illustrative screenshots of a game executed by an electronic game machine implementing the method of FIG. 5;

It will be noted that throughout the appended drawings, like features are identified by like reference numerals.

DETAILED DESCRIPTION

Figure 1:
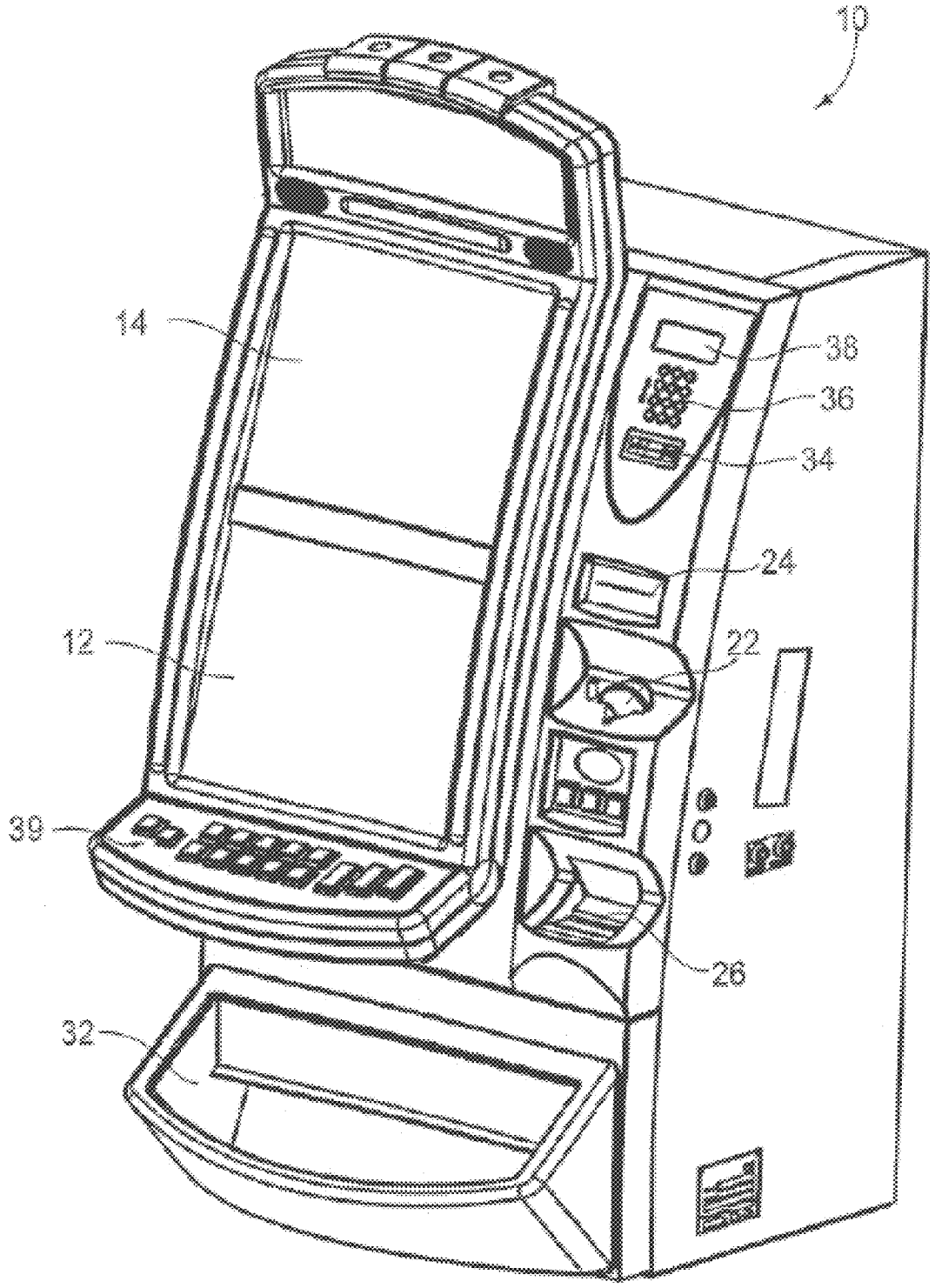
FIG. 1 is a perspective view of an electronic gaming machine for implementing the gaming enhancements, in accordance with one embodiment.

The embodiments of the systems and methods described herein may be implemented in hardware or software, or a combination of both. These embodiments may be implemented in computer programs executing on programmable computers, each computer including at least one processor, a data storage system (including volatile memory or non-volatile memory or other data storage elements or a combination thereof), and at least one communication interface. For example, and without limitation, the various programmable computers may be a server, gaming machine, network appliance, set-top box, embedded device, computer expansion module, personal computer, laptop, personal data assistant, cellular telephone, smartphone device, UMPC tablets and wireless hypermedia device or any other computing device capable of being configured to carry out the methods described herein.

Program code is applied to input data to perform the functions described herein and to generate output information. The output information is applied to one or more output devices, in known fashion. In some embodiments, the communication interface may be a network communication interface. In embodiments in which elements of the invention are combined, the communication interface may be a software communication interface, such as those for inter-process communication. In still other embodiments, there may be a combination of communication interfaces implemented as hardware, software, and combination thereof.

Each program may be implemented in a high level procedural or object oriented programming or scripting language, or a combination thereof, to communicate with a computer system. However, alternatively the programs may be implemented in assembly or machine language, if desired. The language may be a compiled or interpreted language. Each such computer program may be stored on a storage media or a device (e.g., ROM, magnetic disk, optical disc), readable by a general or special purpose programmable computer, for configuring and operating the computer when the storage media or device is read by the computer to perform the procedures described herein. Embodiments of the system may also be considered to be implemented as a non-transitory computer-readable storage medium, configured with a computer program, where the storage medium so configured causes a computer to operate in a specific and predefined manner to perform the functions described herein.

Furthermore, the systems and methods of the described embodiments are capable of being distributed in a computer program product including a physical, non-transitory computer readable medium that bears computer usable instructions for one or more processors. The medium may be provided in various forms, including one or more diskettes, compact disks, tapes, chips, magnetic and electronic storage media, volatile memory, non-volatile memory and the like. Non-transitory computer-readable media may include all computer-readable media, with the exception being a transitory, propagating signal. The term non-transitory is not intended to exclude computer readable media such as primary memory, volatile memory, RAM and so on, where the data stored thereon may only be temporarily stored. The computer useable instructions may also be in various forms, including compiled and non-compiled code.

Throughout the following discussion, numerous references will be made regarding servers, services, interfaces, portals, platforms, or other systems formed from computing devices. It should be appreciated that the use of such terms is deemed to represent one or more computing devices having at least one processor configured to execute software instructions stored on a computer readable tangible, non-transitory medium. For example, a server can include one or more computers operating as a web server, database server, or other type of computer server in a manner to fulfill described roles, responsibilities, or functions. One should further appreciate the disclosed computer-based algorithms, processes, methods, or other types of instruction sets can be embodied as a computer program product comprising a non-transitory, tangible computer readable media storing the instructions that cause a processor to execute the disclosed steps. One should appreciate that the systems and methods described herein may transform electronic signals of various data objects into three-dimensional representations for display on a tangible screen configured for three-dimensional displays. One should appreciate that the systems and methods described herein involve interconnected networks of hardware devices configured to receive data for tracking player movements using receivers and sensors, transmit player movement data using transmitters, and transform electronic data signals for various three-dimensional enhancements using particularly configured processors to modify the display of the three-dimensional enhancements on three-dimensional adapted display screens in response to the tracked player movements. That is, tracked player movements may result in manipulation and movement of various three-dimensional features of a game.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The gaming enhancements described herein may be carried out using any type of computer, including portable devices, such as smart phones, that can access a gaming site or a portal (which may access a plurality of gaming sites) via the internet or other communication path (e.g., a LAN or WAN). Embodiments described herein can also be carried out using an electronic gaming machine (EGM) in various venues, such as a casino. One example type of EGM is described with respect to FIG. 1.

FIG. 1 is a perspective view of an EGM 10 where the three-dimensional enhancements to game components may be provided. EGM 10 includes a display unit 12 that may be a thin film transistor (TFT) display, a liquid crystal display (LCD), a cathode ray tube (CRT), auto stereoscopic three-dimensional display and LED display, an OLED display, or any other type of display. A secondary display unit 14 provides game data or other information in addition to display unit 12. Secondary display unit 14 may provide static information, such as an advertisement for the game, the rules of the game, pay tables, pay lines, or other information, or may even display the main game or a bonus game along with display unit 12. Alternatively, the area for secondary display unit 14 may be a display glass for conveying information about the game. Display unit 12 and/or secondary display unit 14 may also include a camera.

Display unit 12 or 14 may have a touch screen lamination that includes a transparent grid of conductors. Touching the screen may change the capacitance between the conductors, and thereby the X-Y location of the touch may be determined. The processor associates this X-Y location with a function to be performed. Such touch screens may be used for slot machines. There may be an upper and lower multi-touch screen in accordance with some embodiments.

A coin slot 22 may accept coins or tokens in one or more denominations to generate credits within EGM 10 for playing games. An input slot 24 for an optical reader and printer receives machine readable printed tickets and outputs printed tickets for use in cashless gaming.

The gaming machine 10 may include a payment mechanism configured to provide payment to the player based on the game. For example, a coin tray 32 may receive coins or tokens from a hopper upon a win or upon the player cashing out. However, the gaming machine 10 may be a gaming terminal that does not pay in cash but only issues a printed ticket for cashing in elsewhere. Alternatively, a stored value card may be loaded with credits based on a win, or may enable the assignment of credits to an account associated with a computer system, which may be a computer network connected computer.

A card reader slot 34 may accept various types of cards, such as smart cards, magnetic strip cards, or other types of cards conveying machine readable information. The card reader reads the inserted card for player and credit information for cashless gaming. The card reader may read a magnetic code on a conventional player tracking card, where the code uniquely identifies the player to the host system. The code is cross-referenced by the host system to any data related to the player, and such data may affect the games offered to the player by the gaming terminal. The card reader may also include an optical reader and printer for reading and printing coded barcodes and other information on a paper ticket. A card may also include credentials that enable the host system to access one or more accounts associated with a player. The account may be debited based on wagers by a player and credited based on a win. Alternatively, an electronic device may couple (wired or wireless) to the EGM 10 to transfer electronic data signals for player credits and the like. For example, near field communication (NFC) may be used to couple to EGM 10 which may be configured with NFC enabled hardware. This is a non-limiting example of a communication technique.

A keypad 36 may accept player input, such as a personal identification number (PIN) or any other player information. A display 38 above keypad 36 displays a menu for instructions and other information and provides visual feedback of the keys pressed.

The keypad 36 may be an input device such as a touch-screen, or dynamic digital button panel, in accordance with some embodiments.

Player control buttons 39 may include any buttons or other controllers needed for the play of the particular game or games offered by EGM 10 including, for example, a bet button, a repeat bet button, a spin reels (or play) button, a maximum bet button, a cash-out button, a display pay lines button, a display payout tables button, select icon buttons, and any other suitable button. Buttons 39 may be replaced by a touch screen with virtual buttons.

The EGM 10 may also include hardware configured to provide motion tracking. An example type of motion tracking is optical motion tracking. The motion tracking may include a body and head controller. The motion tracking may also include an eye controller. The EGM 10 may implement eye-tracking recognition technology using a camera, sensors (e.g. optical sensor), data receivers and other electronic hardware. Players may move side to side to control the game and game components. For example, the EGM 10 is configured to track player's eyes, so when the eyes move left, right, up or down, a character or symbol on screen moves in response to the player's eye movements. In a navigational game, the player may have to avoid obstacles, or possibly catch items to collect. The virtual movements may be based on the tracking recognition data.

The EGM 10 may include a camera. The camera may be used for motion tracking of player, such as detecting player positions and movements, and generating signals defining x, y and z coordinates. For example, the camera may be used to implement tracking recognition techniques to collect tracking recognition data. As an example, the tracking data may relate to player eye movements. The eye movements may be used to control various aspects of a game or a game component. The camera may be configured to track the precise location of a player's left and/or right eyeballs in real-time or near real-time as to interpret and record the player's eye movement data. The eye movement data may be one way of defining player movements.

For example, the recognition data defining player movement may be used to manipulate or move game components. As another example, the recognition data defining player movement may be used to change a view of the gaming surface or gaming component. A viewing object of the game may be illustrated as a three-dimensional enhancement coming towards the player. Another viewing object of the game may be illustrated as a three-dimensional enhancement moving away from the player. The players head position may be used as a view guide for the viewing camera during a three-dimensional enhancement. A player sitting directly in front of display unit 12 may see a different view than a player moving aside. The camera may also be used to detect occupancy of the machine.

The embodiments described herein are implemented by physical computer hardware embodiments. The embodiments described herein provide useful physical machines and particularly configured computer hardware arrangements of computing devices, servers, electronic gaming terminals, processors, memory, networks, for example. The embodiments described herein, for example, is directed to computer apparatuses, and methods implemented by computers through the processing of electronic data signals.

Accordingly, EGM 10 is particularly configured for moving game components. The display unit 12 and/or the secondary display unit 14 may display via a user interface graphical game components of a game in accordance with a set of game rules using game data, stored in a data storage device.

At least one data capture unit collects player movement data, where the player movement data defines movement of a player of the game. The data capture unit may include a camera, a sensor or other data capture electronic hardware. The EGM 10 may include at least one processor configured to transform the player movement data into data defining game movement for the at least one game component, and generate movement on the display device of the at least one game component using the data defining game movement.

The embodiments described herein involve computing devices, servers, electronic gaming terminals, receivers, transmitters, processors, memory, display, networks particularly configured to implement various acts. The embodiments described herein are directed to electronic machines adapted for processing and transforming electromagnetic signals which represent various types of information. The embodiments described herein pervasively and integrally relate to machines, and their uses; and the embodiments described herein have no meaning or practical applicability outside their use with computer hardware, machines, a various hardware components.

Substituting the computing devices, servers, electronic gaming terminals, receivers, transmitters, processors, memory, display, networks particularly configured to implement various acts for non-physical hardware, using mental steps for example, may substantially affect the way the embodiments work.

Such computer hardware limitations are clearly essential elements of the embodiments described herein, and they cannot be omitted or substituted for mental means without having a material effect on the operation and structure of the embodiments described herein. The computer hardware is essential to the embodiments described herein and is not merely used to perform steps expeditiously and in an efficient manner.

As described herein, EGM 10 may be configured to provide three-dimensional enhancements to game components. The three-dimensional enhancements may be provided dynamically as dynamic game content in response to electronic data signals relating to tracking recognition data collected by EGM 10.

The EGM 10 may include a display with multi-touch and auto stereoscopic three-dimensional functionality, including a camera, for example. The EGM 10 may also include several effects and frame lights. The three-dimensional enhancements may be three-dimensional variants of gaming components. For example, the three-dimensional variants may not be limited to a three-dimensional version of the gaming components.

EGM 10 may include an output device such as one or more speakers. The speakers may be located in various locations on the EGM 10 such as in a lower portion or upper portion. The EGM 10 may have a chair or seat portion and the speakers may be included in the seat portion to create a surround sound effect for the player. The seat portion may allow for easy upper body and head movement during play. Functions may be controllable via an on screen game menu. The EGM 10 is configurable to provide full control over all built-in functionality (lights, frame lights, sounds, and so on).

The EGM 10 may also include a digital button panel. The digital button panel may include various elements such as a touch display, animated buttons, a frame light, and so on. The digital button panel may have different states, such as for example, standard play containing bet steps, bonus with feature layouts, point of sale, and so on. The digital button panel may include a slider bar for adjusting the three-dimensional panel. The digital button panel may include buttons for adjusting sounds and effects. The digital button panel may include buttons for betting and selecting bonus games. The digital button panel may include a game status display. The digital button panel may include animation. The buttons of the digital button panel may include a number of different states, such as pressable but not activated, pressed and active, inactive (not pressable), certain response or information animation, and so on. The EGM 10 may also include physical buttons.

The EGM 10 may include frame and effect lights. The lights may be synchronized with enhancements of the game. The EGM 10 may be configured to control color and brightness of lights. Additional custom animations (color cycle, blinking, etc.) may also be configured by the EGM 10. The customer animations may be triggered by certain gaming events.

Figure 2A:
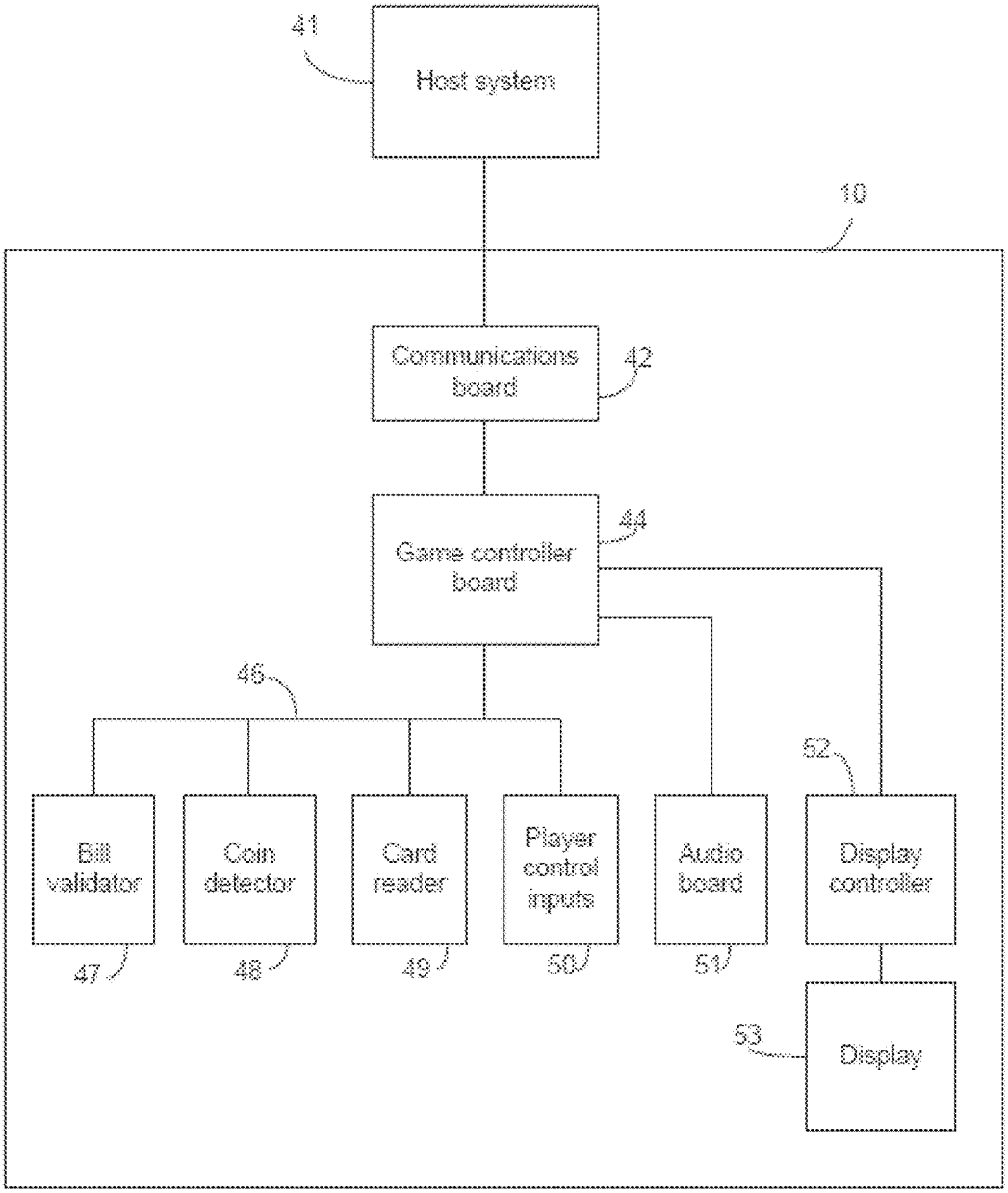
FIG. 2A is a block diagram of an electronic gaming machine linked to a casino host system, in accordance with one embodiment.
Figure 2B:
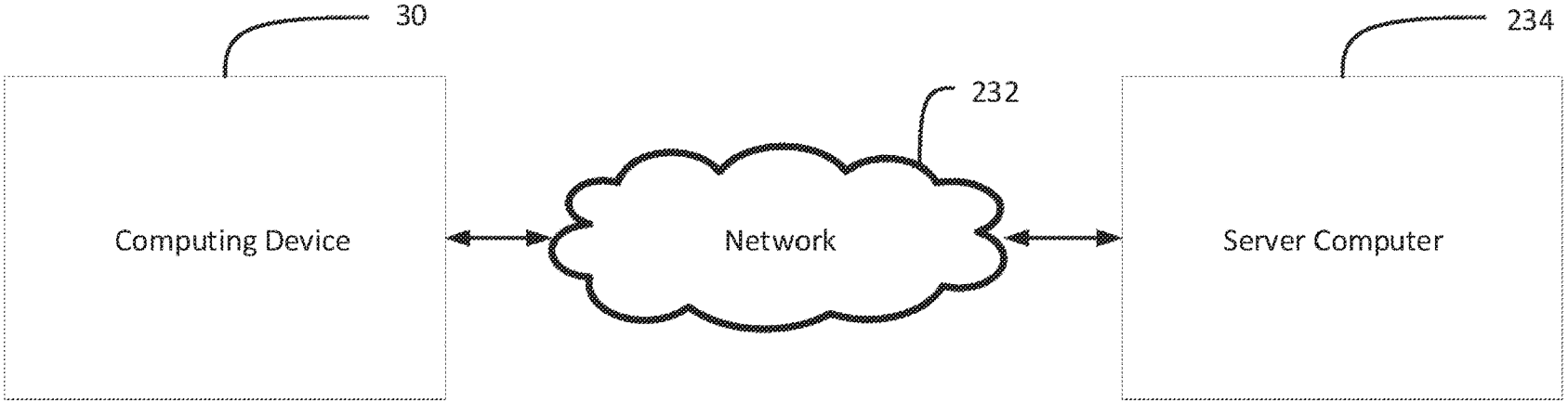
FIG. 2B is an exemplary online implementation of a computer system and online gaming system.

FIG. 2A is a block diagram of EGM 10 linked to the casino's host system 41. The EGM 10 may use conventional hardware. FIG. 2B illustrates a possible online implementation of a computer system and online gaming device in accordance with the present gaming enhancements. For example, a server computer 234 (also referred to herein as a gaming server) may be configured to enable online gaming in accordance with embodiments described herein. One or more players may use a computing device 30 (which may be the EGM 10) that is configured to connect to the Internet 232 (or other network), and via the Internet 232 to the server computer 234 in order to access the functionality described in this disclosure. The server computer 234 may include a movement recognition engine that may be used to process and interpret collected player movement, to transform the data into data defining manipulations of game components or view changes.

A communications board 42 may contain conventional circuitry for coupling the EGM 10 to a local area network (LAN) or other type of network using any suitable protocol, such as the G2S protocols. Internet protocols are typically used for such communication under the G2S standard, incorporated herein by reference. The communications board 42 transmits using a wireless transmitter, or it may be directly connected to a network running throughout the casino floor. The communications board 42 basically sets up a communication link with a master controller and buffers data between the network and the game controller board 44. The communications board 42 may also communicate with a network server, such as in accordance with the G2S standard, for exchanging information to carry out embodiments described herein.

The game controller board 44 contains memory and a processor for carrying out programs stored in the memory and for providing the information requested by the network. The game controller board 44 primarily carries out the game routines.

Peripheral devices/boards communicate with the game controller board 44 via a bus 46 using, for example, an RS-232 interface. Such peripherals may include a bill validator 47, a coin detector 48, a smart card reader or other type of credit card reader 49, and player control inputs 50 (such as buttons or a touch screen). Other peripherals may be one or more cameras used for collecting eye-tracking recognition data, or other player movement recognition data.

The game controller board 44 may also control one or more devices that produce the game output including audio and video output associated with a particular game that is presented to the player. For example audio board 51 may convert coded signals into analog signals for driving speakers. A display controller 52, which typically requires a high data transfer rate, may convert coded signals to pixel signals for the display 53. Display controller 52 and audio board 51 may be directly connected to parallel ports on the game controller board 44. The electronics on the various boards may be combined onto a single board.

Computing device 30 may be particularly configured with hardware and software to interact with gaming machine 10 or gaming server 234 via network 232 to implement gaming functionality and render three-dimensional enhancements, as described herein. For simplicity only one computing device 30 is shown but system may include one or more computing devices 30 operable by players to access remote network resources. Computing device 30 may be implemented using one or more processors and one or more data storage devices configured with database(s) or file system (s), or using multiple devices or groups of storage devices distributed over a wide geographic area and connected via a network (which may be referred to as "cloud computing").

Computing device 30 may reside on any networked computing device, such as a personal computer, workstation, server, portable computer, mobile device, personal digital assistant, laptop, tablet, smart phone, WAP phone, an interactive television, video display terminals, gaming consoles, electronic reading device, portable electronic devices, wearable electronic device, or any suitable combination of these.

Computing device 30 may include any type of processor, such as, for example, any type of general-purpose microprocessor or microcontroller, a digital signal processing (DSP) processor, an integrated circuit, a field programmable gate array (FPGA), a reconfigurable processor, a programmable read-only memory (PROM), or any combination thereof. Computing device 30 may include any type of computer memory that is located either internally or externally such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like.

Computing device 30 may include one or more input devices, such as a keyboard, mouse, camera, touch screen and a microphone, and may also include one or more output devices such as a display screen (with three-dimensional capabilities) and a speaker. Computing device 30 has a network interface in order to communicate with other components, to access and connect to network resources, to serve an application and other applications, and perform other computing applications by connecting to a network (or multiple networks) capable of carrying data including the Internet, Ethernet, plain old telephone service (POTS) line, public switch telephone network (PSTN), integrated services digital network (ISDN), digital subscriber line (DSL), coaxial cable, fiber optics, satellite, mobile, wireless (e.g. Wi-Fi, WiMAX), SS7 signaling network, fixed line, local area network, wide area network, and others, including any combination of these. Computing device 30 is operable to register and authenticate players (using a login, unique identifier, and password for example) prior to providing access to applications, a local network, network resources, other networks and network security devices. Computing device 30 may serve one player or multiple players.

While the following paragraphs refer to the EGM 10, it should be understood that the embodiments described herein may be implemented on the computing device 30, which may take a plurality of different forms including, as mentioned supra, mobile devices such as smartphones, and other portable or wearable electronic devices.

Figure 3:
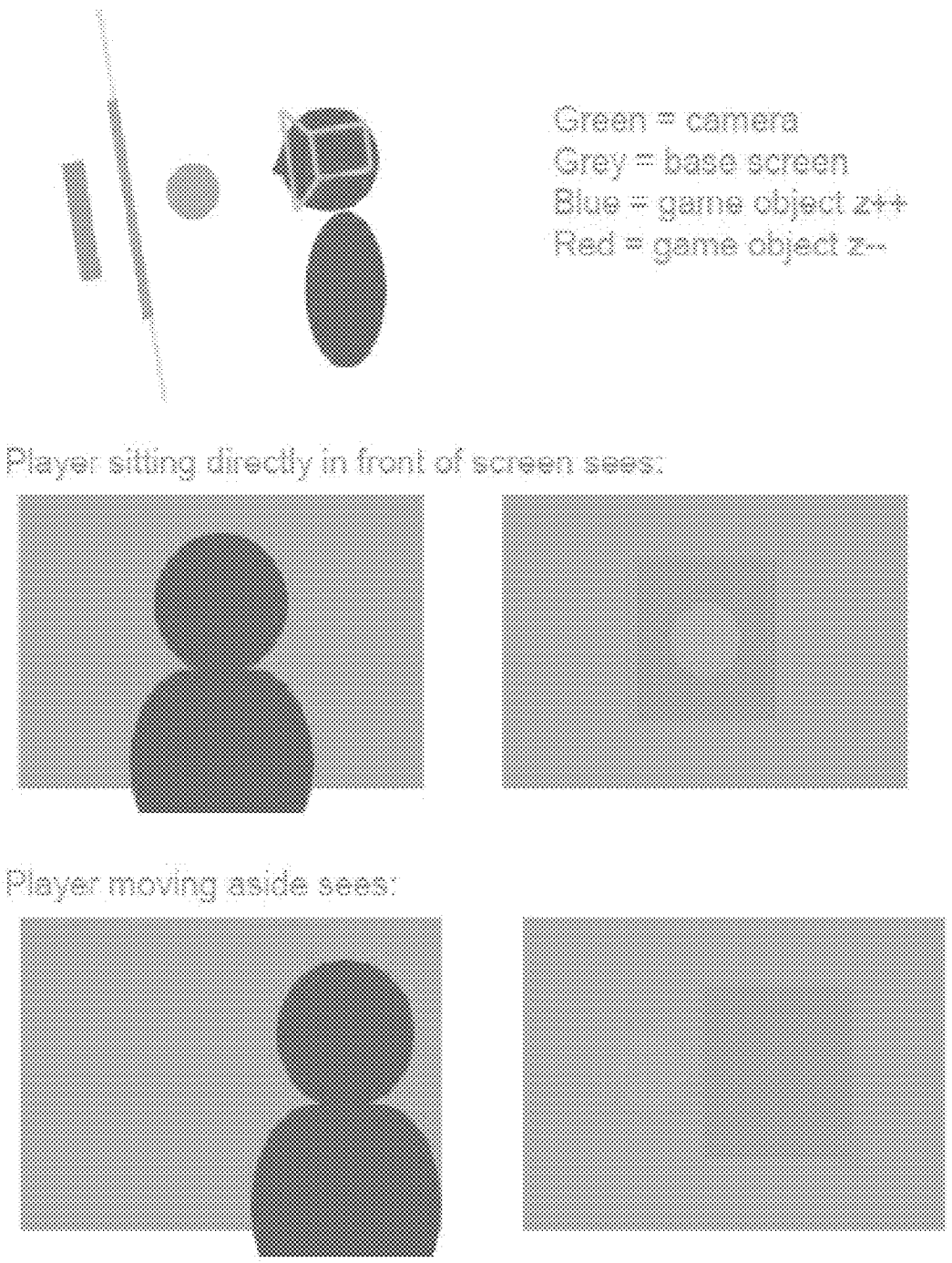
FIG. 3 illustrates an electronic gaming machine with a camera for implementing the gaming enhancements, in accordance with some embodiments.

FIG. 3 illustrates an electronic gaming machine with a camera 15 for implementing the gaming enhancements, in accordance with some embodiments. The EGM 10 may include the camera 15, sensors (e.g. optical sensor), or other hardware device configured to capture and collect data relating to player movement.

In accordance with some embodiments, the camera 15 may be used for motion tracking, and movement recognition. The camera 15 may collect data defining x, y and z coordinates representing player movement.

In some examples, a viewing object of the game (shown as a circle in front of the base screen) may be illustrated as a three-dimensional enhancement coming towards the player. Another viewing object of the game (shown as a rectangle behind the base screen) may be illustrated as a three-dimensional enhancement moving away from the player. The players head position may be used as a view guide for the viewing camera during a three-dimensional enhancement. A player sitting directly in front of display unit 12 may see a different view than a player moving aside. The camera 15 may also be used to detect occupancy of the machine. The camera 15 and/or a sensor (e.g. an optical sensor) may also be configured to detect and track the position(s) of a player's eyes or more precisely, pupils, relative to the screen of the EGM 10.

The camera 15 may also be used to collect data defining player eye movement, gestures, head movement, or other body movement. Players may move side to side to control the game. The camera 15 may collect data defining player movement, process and transform the data into data defining game manipulations (e.g. movement for game components), and generate the game manipulations using the data. For example, player's eyes may be tracked by camera 15 (or another hardware component of EGM 10), so when the eyes move left, right, up or down, their character or symbol on screen moves in response to the player's eye movements. The player may have to avoid obstacles, or possibly catch or contact items to collect depending on the type of game. These movements within the game may be directed based on the data derived from collected movement data.

In one embodiment of the invention, the camera 15 is coupled with an optical sensor to track a position of a player's each eye relative to a center of a EGM 10's screen, as well as a focus direction and a focus point on the EGM 10's screen of the player's both eyes in real-time or near real-time. The focus direction can be the direction at which the player's line of sight travels or extends from his or her eyes to the EGM 10's screen. The focus point may sometimes be referred to as a gaze point and the focus direction may sometimes be referred to as a gaze direction. In one example, the focus direction and focus point can be determined based on various eye tracking data such as position(s) of a player's eyes, a position of his or her head, position(s) and size(s) of the pupils, corneal reflection data, and/or size(s) of the irises. All of the above mentioned eye tracking or movement data, as well as the focus direction and focus point, may be examples of, and referred to as, player's eye movements or player movement data.

Figure 4:
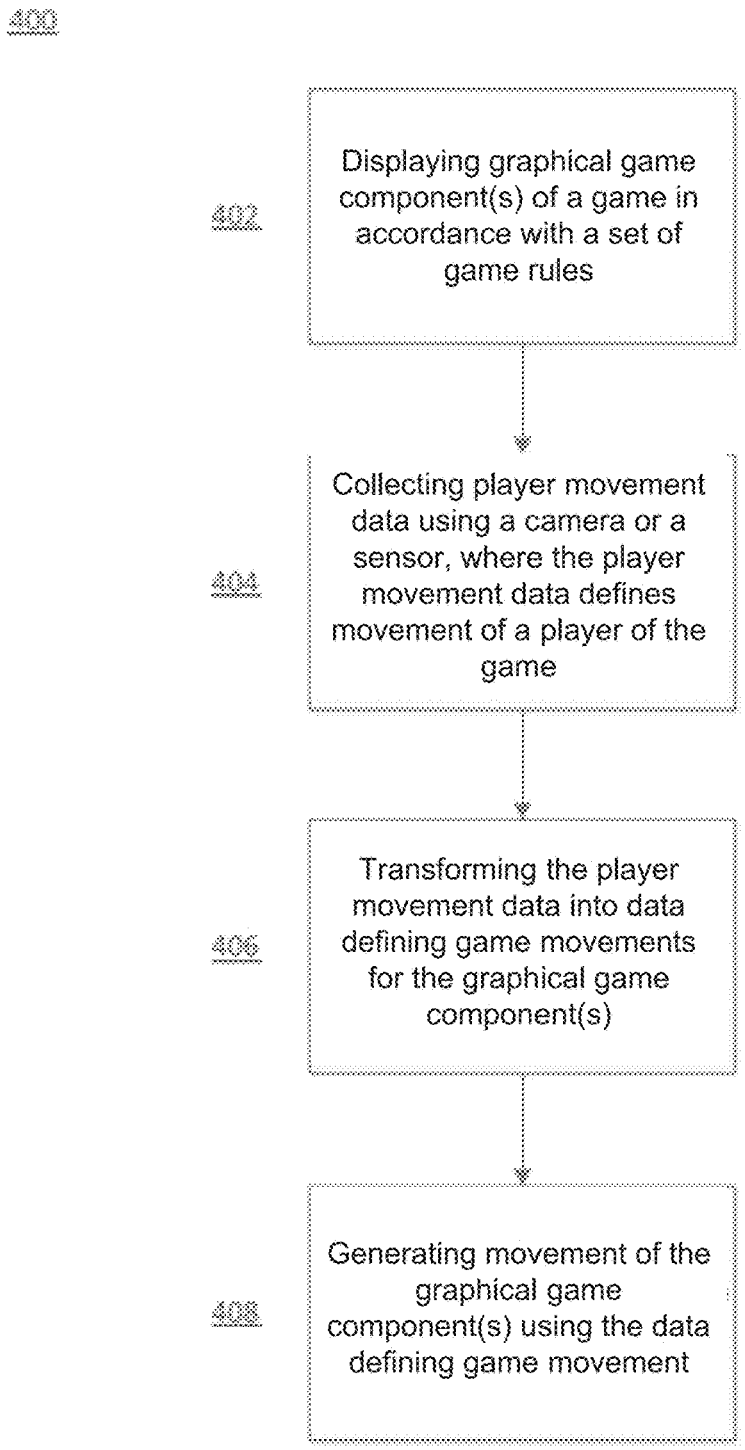
FIG. 4 illustrates a flowchart diagram of an exemplary computer-implemented method for the game component enhancements.

Referring now to FIG. 4, there is shown a flowchart diagram of an exemplary computer-implemented method 400 for moving game component in a gaming system such as that illustrated in FIGS. 1, 2A, and 2B.

At 402, the EGM 10 displays on a display device, such as display unit 12 and/or secondary display unit 14, a user interface showing one or more graphical game components of a game in accordance with a set of game rules for the game. The game component may be a virtual character, a gaming symbol, a stack of game components along an axis orthogonal to a plane of the display device, a multi-faceted game component, a reel, a grid, a multi-faceted gaming surface, and gaming surface, or a combination thereof.

A game component may be selected to move or manipulate with the player's eye movements. The gaming component may be selected by the player or by the game. For example, the game outcome or state may determine which symbol to select for enhancement.

At 404, a data capture unit collects player movement data, where the player movement data defines movement of the player. The data capture unit may be a camera, a sensor, and/or other hardware device configured to capture and collect data relating to player movement. The data capture unit may integrally connect to EGM 10 or may be otherwise coupled thereto.

As previously described, the camera 15 may be coupled with an optical sensor to track a position of a player's each eye relative to a center of a EGM 10's screen, as well as a focus direction and a focus point on the EGM 10's screen of the player's both eyes in real-time or near real-time. The focus direction can be the direction at which the player's line of sight travels or extends from his or her eyes to the EGM 10's screen. The focus point may sometimes be referred to as a gaze point and the focus direction may sometimes be referred to as a gaze direction. In one example, the focus direction and focus point can be determined based on various eye tracking data such as position(s) of a player's eyes, a position of his or her head, position(s) and size(s) of the pupils, corneal reflection data, and/or size(s) of the irises. All of the above mentioned eye tracking or movement data, as well as the focus direction and focus point, may be instances of player movement data.

In addition, a focus point may extend to or encompass different visual fields visible to the player. For example, a foveal area may be a small area surrounding a fixation point on the EGM 10's screen directly connected by a (virtual) line of sight extending from the eyes of a player. This foveal area in the player's vision generally appears to be in sharp focus and may include one or more game components and the surrounding area. In this disclosure, it is understood that a focus point may include the foveal area immediately adjacent to the fixation point directly connected by the (virtual) line of sight extending from the player's eyes.

The player movement data may relate to the movement of the player's eyes. For example, the player's eyes may move or look to the left which may trigger a corresponding movement of a game component within the game. The movement of the player's eyes may also trigger an updated view of the entire game on display to reflect the orientation of the player in relation to the display device. The player movement data may also be associated with movement of the player's head, or other part of the player's body. As a further example, the player movement data may be associated with a gesture made by the player, such as a particular hand or finger signal.

At 406, a processor of EGM 10 (e.g. coupled thereto or part thereof) may transform the player movement data into data defining game movement for the game component(s).

At 408, the processor generates movement of the game component(s) using the data defining game movement. The display device updates to visually display the movement of the game component(s) for the player. The movement may be a rotation about an axis, or directional movement (e.g. left, right, up, down), or a combination thereof. The movement may also be an update a view of the game on the display using the data defining game movement.

Accordingly, the EGM 10 is configured to monitor and track player movement including eye movement data, and in response generate corresponding movements of the game component(s). The EGM 10 (e.g. processor) may be programmed with control logic to map different player movements to different movements of the game component(s).

Figure 5:
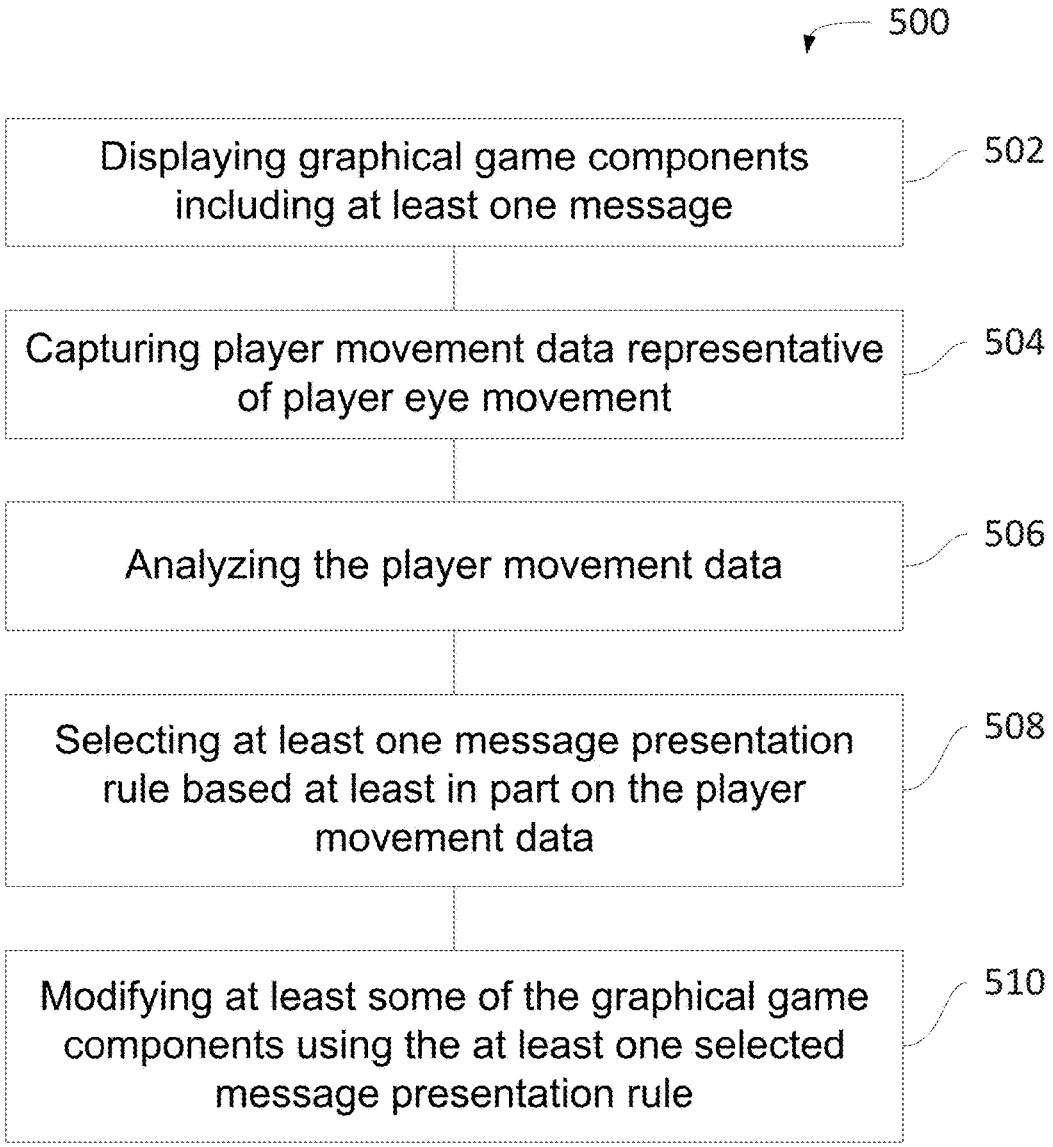
FIG. 5 illustrates a flowchart diagram of an exemplary computer-implemented method for modifying graphical game components.

With reference to FIG. 5, a specific embodiment, namely a method 500, wherein the EGM 10 is configured to modify one or more graphical game components presented via the graphical user interface based on player movement is described. The modification may be in order to alter graphical game components already presented via the graphical user interface, may be in order to remove certain graphical game components, or in order to add graphical game components which are not presented via the graphical user interface. While many different types of graphical game components are considered, the present embodiment focuses on the presentation of messages for conveying information to the player of the game. These messages may convey any particular information to the player, including (but not limited to) advertisements, public service announcements, game-related information (such as tips, tricks, or other game-related help), and the like. The message may also be from another person, such as another player of the game (playing via a separate EGM 10), and may be sent as an instant message (IM), or any other suitable message format.

In step 502, the EGM 10 may display graphical game components including at least one message. As discussed above, the message or messages (hereinafter "messages") may convey any suitable information which may be relevant or of interest to the player playing the game at the EGM 10. The messages may be presented in any suitable format, including size, font, colour, outline, background, shadow, etc. In some cases, the particular format of the message presentation may be preset, such that all messages have a default format. In other cases, the particular presentation of a message may vary from message to message: for example, advertisement messages may be a certain colour different from the colour in which public service announcements are presented. In still further cases, the player may be able to set their own preferences for the default presentation of messages. While this may allow the player partial or complete control over the default way messages are presented, alternatively (or in addition) the player may be presented with a set of default message presentation schemes and may select one or more from a list. This may include, for example, light and dark message presentation schemes, or message presentation schemes aimed at colourblind players or players with other visual impairments.

Additionally, the messages may be presented in any suitable language and character set. In some cases, the EGM 10 may have a preset language, and the messages may be presented in the preset language; in other cases, the EGM 10 may prompt the player, via the graphical user interface, to select a display language from a collection of available display languages, and the messages may be presented in the selected display language.

At step 504, the EGM 10 may collect player movement data. Player movement data may be collected via the camera 15, or via any other suitable sensor mentioned hereinabove. Player movement data may be representative of movement of the player, and more specifically of movement of a body of the player, a body part of the player, a head of the player, or of one or more eyes of the player. The player movement data may be captured in a substantially real-time stream, at periodic intervals, or based on one or more triggers internal or external to the EGM 10. In some cases, the tracking of player movement data may be a premium feature available to only certain players: premium features may be allocated to players who play games at a certain frequency, or who spend a certain amount of money playing (on the whole or per unit time). Access to premium features may be tied to the player account.

At step 506, the player movement data collected at step 504 is analyzed by the EGM 10, and more specifically by the game controller board 44. The analysis may be performed in any suitable fashion, including motion detection, edge detection, full-scale detection, and the like. The player movement data may be analyzed to detect, for example, motion of the player's body, head, eyes, or any combination thereof, in three-dimensional space. In some embodiments, the player movement data may be analyzed to determine the location and orientation of the player's eye or eyes, which may include determining a location at which the player is looking, specifically a location on the display unit 12 or the secondary display unit 14 at which the player is looking. Alternatively, or in addition, the player movement data may be analyzed to determine the direction and/or speed of motion of the player's eye or eyes.

In cases where the analysis of the player movement data indicates that the player is not looking at either display unit 12 or the secondary display unit 14, the EGM 10 may be interested in the last location on the display unit 12 or the secondary display unit 14 at which the player was looking. As such, the analysis of the player movement data may be stored, temporarily or permanently, in the memory of the game controller board 44.

At step 508, the EGM 10 selects at least one message presentation rule, based at least in part on the player movement data. The message presentation rules may be stored—as a part of the game data—in the data storage device, and may provide instructions which prescribe ways in which graphical game components are presented via the display unit 12 and/or the secondary display unit 14. The message presentation rules may prescribe modifications that should be made to the presentation of the graphical game components, specifically the graphical game components which convey the message to the player.

The message presentation rules may, for example, prescribe altering the size, colour, shape, or any combination thereof, of any one or more parts of the message. The message presentation rules may prescribe removing certain parts of the message, or presenting certain parts of the message which are not currently displayed via the display unit 12 or the secondary display unit 14. The specific message presentation rule, and the changes effected on the graphical game components forming the message, may vary with the particular player movement data collected and the analysis of the player movement data.

In step 510, the EGM 10 modifies at least some of the three-dimensional graphical game components using the message presentation rule. In some cases, these modified graphical game components may be presented on the same display unit 12, 14, on which they were originally presented; alternatively, if the original graphical game components are presented on the display unit 12, the modified graphical game components may be presented on the secondary display unit 14, and vice-versa. It should be noted that the above-presented steps may be repeated as many times as desired in response to further player movement data being collected. The following paragraphs describe an exemplary embodiment thereof with reference to FIGS. 6A-D.

With reference to FIG. 6A, a player may be presented with a game screen 600 comprising a plurality of graphical game components, including a message box 610 presenting a message 612. The message 612 comprises a plurality of words, in this case "REMEMBER TO TRY OUT THE BUFFET!" which form an advertisement message. While the message box 610 is located in the top portion of the game screen 600, it should be noted that in other implementations the message box 610 may be located elsewhere in the game screen 600. Additionally, while the message 612 is shown here with black lettering having white outline overlain on a semi-transparent black background, it should be understood that the message may be presented in any other suitable way.

With reference to FIG. 6B, when the player moves their eye or eyes to read the contents of the message 612, the EGM 10 detects the movement of the player's eye or eyes and acquires player movement data as discussed in step 504. The EGM 10 may then analyze this player data, as in step 506, and discern that the player is looking at the first word in the message 612, namely "REMEMBER". Based on this analysis, the EGM 10 may select at least one message presentation rule, as in step 508, and may modify at least some of the graphical game components using the at least one selected message presentation rule. As is shown in FIG. 6B, the message presentation rule prescribes that the graphical game components associated with the word currently being read by the player be altered: in this case, the colour of the word "REMEMBER" is modified to be tan with white outline instead of black with white outline, which is the default colour scheme for the words in the message 612. Accordingly, the remainder of the words of the message 612 (namely "TO TRY OUT THE BUFFET!") are black with white outline. Other types of modifications to the graphical game components associated with the word currently being read are also considered, such as changing the size of the word, the shape of the word, adding shadow or background colour to the word, and the like.

Referring to FIG. 6C, the player has now read through most of the message 612 and is now reading the word "BUFFET!". Accordingly, all of the words already read (namely "REMEMBER TO TRY OUT THE") are shown in the default colour scheme, and only the word "BUFFET!" is shown in tan and white.

Referring to FIG. 6D, the player has now finished reading the word "BUFFET!" and has arrived at the end of the message 612. Upon acquiring player movement data which, when analyzed, indicates that the player has finished reading the message 612, the EGM 10 selects a message presentation rule which modifies the graphical game components to remove the message 612 and to present a new message 614, as shown in FIG. 6D. Once the new message 614 is displayed on the display unit 12 or the secondary display unit 14, the process described in method 500 may repeat as the player begins reading message 614.

Additionally, while the example presented in FIGS. 6A-D show message presentation rules prescribing the presentation of the graphical game components associated with the word currently being read by the player, it should be noted that other message presentation rules may prescribe the presentation of the graphical game components associated with the word or words the player has just finished reading, or is about to read (i.e., excluding the word currently being read). Such message presentation rules may prescribe, for example, reducing the size or fading the colour of words the player has just finished reading, or increasing the size or enhancing the colour of words the player is about to read. Alternatively, the message box 610 may be configured for presenting a message 612 comprising more than one line of text (where each line comprises at least one word), and some message presentation rules may prescribe altering the graphical game components on a line-by-line basis rather than on a word-by-word basis, such as is described above. This may include, for example, highlighting the line a player is reading when they begin reading the line, or fading the line a player has finished reading when the player moves to the next line. Similarly, a message presentation rule may prescribe removing a line when a player reaches the end of the line of the message 612 and moving all remaining lines in the message 612 upward, such that the new line a player is about to read takes the position of the line the player has just finished reading. Other message presentation rules are also considered, which may modify the graphical game components associated with the words or lines of the message 612 in other suitable fashions.

The message presentation rules may also be selected on the basis of the speed or pace at which the player is reading the message 612. That is to say, the EGM 10 may analyze the player movement data over one or more messages 612, or while the player reads other unrelated text (such as a welcome screen, instructions, and the like) and determine the pace at which the player generally reads. Then, the EGM 10 may select at least one presentation rule based on the reading pace of the player. Additionally, the EGM 10 may be configured to re-evaluate the reading pace of the player periodically, and to potentially select at least one different message presentation rule based on an updated analyzed reading pace. The EGM 10 may also make certain inferences based on the change in the reading pace of the player. For example, if the reading pace of a player slows, this may indicate that the player is tired, in which case the EGM 10 may present a new message 612 to the player indicating where the player may acquire coffee or an energy drink. Of course, other inferences may be drawn based on a change in reading pace.

Additionally, the step 506 of analyzing the player movement data may indicate that the player's gaze is fixated on a specific word or group of words of the message 612. This may be indicative of the player's inability to read or understand the specific word or group of words. In this case, the EGM 10 may select at least one message presentation rule which modifies at least some of the graphical game components for presenting this word or group of words of the message, for example making the words larger, or increasing the spacing between the characters of the word or group of words. For languages where words may be represented in a plurality of character sets, some message rules may prescribe changing the particular character set used to display the message 612. In some cases, the message presentation rule may cause additional graphical game components to be displayed, such as a definition of the word or group of words on which the player's gaze is fixated. Alternatively, or in addition, the EGM 10 may be configured for providing audio support to the player, which may include reading a portion or the whole of the message 612 out loud to the player. To this end, the EGM may comprise a text-to-speech module which may output, via the audio board 51, an audio representation of the message 612. If the player's gaze is still fixated on the specific word or group of words after the audio representation has been output, the EGM 10 may repeat the audio representation at a higher volume, at a slower speed, or in any other suitable way.

The player's gaze being fixated on the specific word or group of words may also, or alternatively, be indicative of the player being dazed or "spacing out". In order to focus the player's attention, the EGM 10 may display graphical game components configured to startle or otherwise recapture the attention of the player. This may include displaying bright animations or animations which change in colour or intensity rapidly over time, playing loud or high-pitched sound cues, and the like.

The EGM 10 may also be configured for collecting marketing analytics. These marketing analytics may relate to a number of factors regarding read events, wherein the player reads or views messages 612 presented in the message box 610. This may include the number of read events per unit time, the number of read events per game played or per individual game event, the speed or pace at which different types of messages are read or viewed, the time between read events, and the like, If the EGM 10 presents messages 612 which are interactive, the EGM 10 may also collect marketing analytics regarding the number of read events which result in an interaction by the player.

In this vein, the EGM 10 may use a camera or other sensor, such as the camera 15, to capture player movement data for use in advertising and marketing initiatives. Generally speaking, the EGM 10 may track the location on the display unit 12 (or the secondary display unit 14) where the player is looking, and may record the amount of time the player spends looking at different graphical game components displayed on the display unit 12 in a database, or using any other suitable data recording system. Thus, the EGM 10 may be configured for storing player movement data representative of the amount of time spent by the player looking at certain given graphical game components, or more generally, representative of visual interactions of the play with at least one graphical game component. To this end, each graphical game component, or each group or subgroup of graphical game components, may be categorized using at least one metadata tag. The metadata tags may comprise information about a given graphical game component with which it is associated: this information may include, for example, information about the colour, the shape, the size, the animation type or speed, and the positioning of the given graphical game component, and may further including contextual information relating to the graphical game components which surround the given graphical game component. The metadata tags may include any other suitable information relating to the graphical game component to which it is associated.

When storing the player movement data representative of the player's visual interactions with advertisements, the player movement data may be stored in association with the metadata of the graphical game components the player with which the player was interacting visually. This may include an indication of the graphical game elements with which the player spent the most time interacting, the graphical game elements on which the player focused his or her gaze, and the like, as well as a general advertisement viewing history. The EGM 10 may also store advertisement statistics on a per-game basis, irrespective or not of the player playing the game, which may be analyzed to determine if certain games are more conducive to interactions with advertisements, and the like.

In certain embodiments, a certain portion of the display unit 12 (or the secondary display unit 14) may be substantively reserved for the presentation of advertisements. For example, a top portion of the display unit 12 may be reserved for advertisements while the player is currently playing a game; the EGM 10 may also, or alternatively, reserve a bottom portion, a side portion, or any other suitable portion for displaying advertisements. Alternatively still, or in addition, the secondary display unit 14 may be devoted wholly or in part to the presentation of advertisements. In some embodiments, the EGM 10 may change, throughout a play session during which the player is playing the game, the location where advertisements are displayed; the EGM 10 may be further configured for determining locations on the display unit 12 (or the secondary display unit 14) which are more conducive to the player interacting visually with advertisements.

Advertisements may be acquired from a local or remote advertisement database, and each advertisement (or series of advertisements) may be associated with respective advertising metadata, which includes descriptions of the advertisement to which the metadata is associated, including advertisement type, advertisement length, topic, target demographic, etc. The EGM 10 may be configured for accessing the advertisement database, for acquiring at least one advertisement therefrom, and/or for cycling advertisements on the display unit 12 (or the display unit 14) at suitable time intervals or based on suitable triggers. As discussed supra, the EGM 10 may cycle advertisements based on determining that the player has finished reading the advertisement currently displayed. The EGM 10 may also cycle advertisements based on player movement data collected and stored in the database.

In this way, the EGM 10 may analyze the player movement data, stored in association with graphical game component metadata, to determine various advertising preferences of the player. When selecting a new advertisement to present, the EGM 10 may consider the advertising preferences of the player—these may be stored in any suitable location, such as a local database or a remote database (including the cloud). The advertising preferences of the player may be linked to the player account, in the form of an advertising profile, such that the advertising preferences of the player are available to any EGM 10 that is suitably configured. In some embodiments, the advertising preferences of the player may be linked to a card associated with the player which may be read by the card reader slot 34.

The content of advertisements may also be altered based on the player's advertising preferences. For example, in a context where the EGM 10 presents an advertisement for apparel, such as a shirt, if the EGM 10 determines that the player is most attentive to graphical game components in advertisements that are of a certain colour, such as blue, the EGM 10 may choose to present the shirt as blue in the advertisement, though the shirt may be available in a variety of colours.

In some embodiments, it may be possible for an operator of the EGM 10 to share the advertising preferences of the player with advertising entities who advertise on platforms other than the EGM 10. For example, the operator of the EGM 10 may provide advertising preferences for at least one player to a web advertiser which performs advertising on the Internet, such that the web advertiser may also present advertisements to the player which are at least in part based on the advertising preferences of the player. Additionally, the web advertiser may also collect information regarding the success rate of the online advertisements and provide this information to the operator of the EGM 10 to further refine the advertising preferences of the player. In this fashion, the operator of the EGM 10 and the web advertiser may partner to improve the advertising preferences of the player.

Where the EGM 10 is implemented as a mobile device, the mobile device may display advertisements along the sides, the top, or the bottom of a screen of the mobile device, or may display advertisements over the content of the game during pauses in gameplay. In such embodiments, the mobile device may additionally make use of location-finding services of the mobile device to further tailor the advertisements to the player, in addition to any tailoring done based on the advertising preferences of the player. The location services used may include GPS (and any variant thereof), W-Fi-based tracking, mobile triangulation, and the like. The mobile device may also be configured for acquiring player movement data and for further supplementing the database with the player movement data to further refine the advertising preferences of the player.

The mobile device may also be configured for interacting with one or more venues located in proximity to the player and the mobile device. For example, a venue server located at one such venue may be configured for detecting the mobile device being in proximity to the venue server and for then providing the mobile device with targeted advertisements which may be based at least in part on the advertising preferences of the player. Additionally, if the mobile device detects that the player interacts visually with a given advertisement for more than a predetermined amount of time, or in a certain way, the mobile device may determine that the player is interested in a product or service featured in the advertisement and communicate this to the venue server in the form of a message or request. In response, the venue server may return a message to the mobile device for presentation to the player: this message may include a notification, an alert, a text message, or an advertisement presented in any other suitable format which features the product or service with which the player previously interacted visually.

The EGM 10 may further reward players for interacting visually with advertisements. Players may be rewarded for each visual interaction, for every $n^{th}$ visual interaction, for performing more than a certain number of visual interactions in a certain time period, or based on any other suitable metric. The rewards provided to the player may be in the form of in-game credits or game money, or other "internal" rewards, such as providing access to a hidden game mode, unlocking in-game perks, and the like. Alternatively, or in addition, the rewards may be "external", such as free refreshments or access to a buffet or restaurant. Other types of rewards, be they internal or external, are also considered. These rewards may be provided "in secret", insofar as the player is not made aware that he or she is being rewarded for particular behaviour (i.e. the rewards appear to be "random"), or the user may be made explicitly aware that certain behaviour, such as interacting visually with one or more advertisements, will result in them being rewarded. In embodiments where the EGM 10 is interacting with the venue server, the venue server may specify the nature of the rewards afforded to the player. The venue server may be implemented as any suitable server, such as a physical server or a cloud-based server.

In some embodiments, the advertisements served to the EGM 10 may be submitted by an advertiser by way of an online portal or web interface. The advertiser may access the web interface and submit at least one ad, and may associate metadata tags to the advertisement. As discussed supra, the metadata may be used to select an appropriate advertisement for the player based on the advertising preferences of the player. The advertiser may additionally specify, via the web interface, the types of rewards offered to the player as well as the conditions for handing out the rewards. In some embodiments, the web interface may be implemented on an advertisement server which comprises sufficient hardware and/or software to perform image detection or natural language processing to suggest or automatically apply metadata tags which are relevant to the advertisement. The advertising server may also make use of previously submitted advertisements and their associated metadata tags, to perform machine learning and establish rules for suggesting metadata tags to be applied to advertisements submitted via the web interface. The web interface may also provide the advertiser with an indication of how well received the advertisement may be by certain demographic groups. To do this, the advertising server may consider the nature of the advertisement and the associated metadata, as well as any information obtained by the advertising server through performing image detection and natural language processing of the advertisement in question. The web interface and the advertising server which implements the web interface may also provide further advertising-related features to the advertiser.

Figure 7:
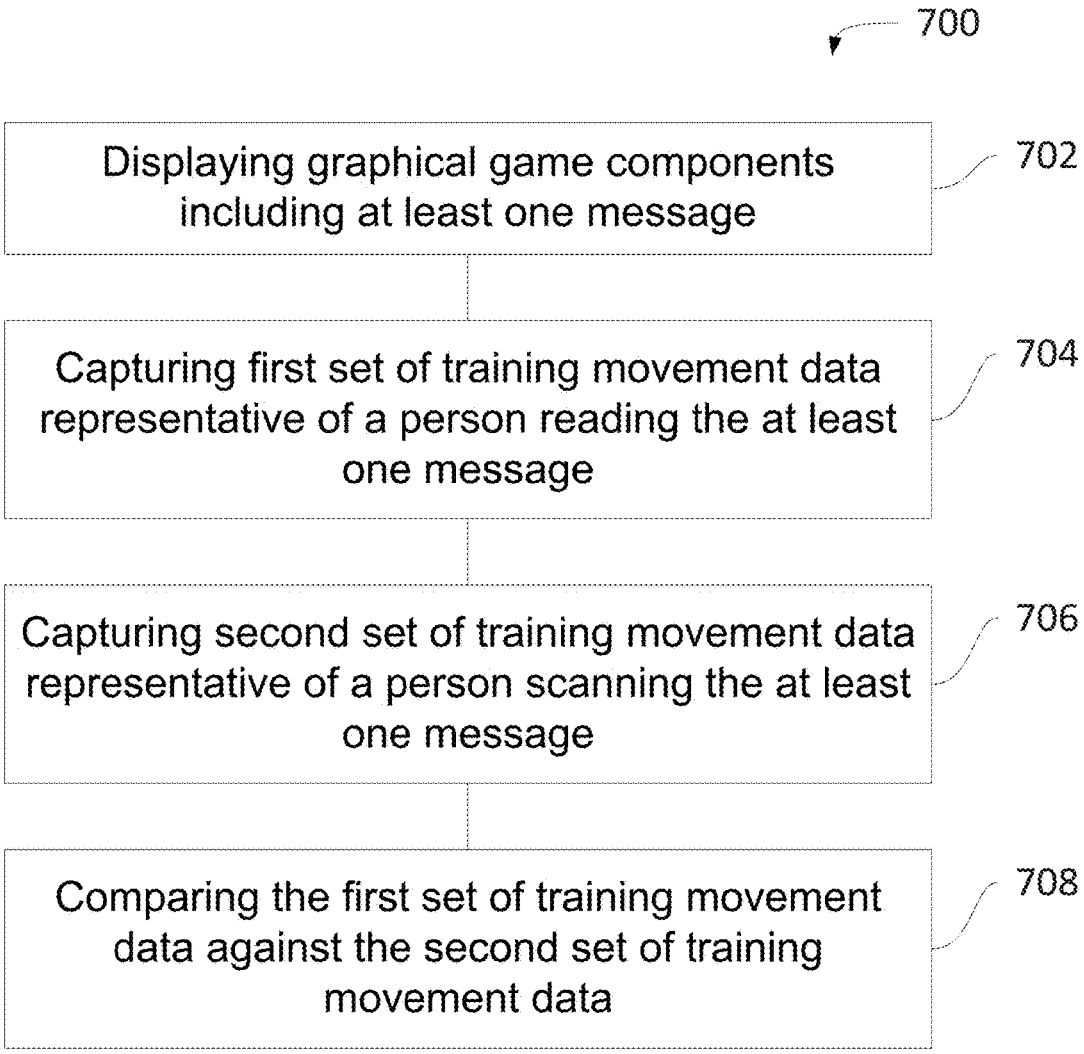
FIG. 7 illustrates a flowchart diagram of an exemplary computer-implemented method for training an electronic gaming machine to detect a player reading a message versus scanning a message.

With reference to FIG. 7, a method 700 for training the EGM 10 to recognize reading is described. It may be desirable to prevent a player from tricking the EGM 10 into believing they are reading the messages 612, 614 when they are instead merely scanning the messages 612, 614. As such, the method 700 is provided to teach the EGM 10 the difference, in order to prevent the EGM from handing out rewards, for example, when the player has not properly read the messages 612, 614, presented in the message box 610.

At step 702, the EGM 10 may display graphical game components including at least one message to be read. The message presented by the EGM 10 may be similar to the messages described hereinabove, including messages 612, 614.

At step 704, the EGM 10 captures a first set of training movement data. Training movement data may be collected via the camera, or via any other suitable sensor mentioned hereinabove. The first set of training movement data may be representative of eye movement of a person reading the message presented at step 702. The training movement data may be captured in a substantially real-time stream, at periodic intervals, or based on one or more triggers internal or external to the EGM 10

At step 706, the EGM 10 captures a second set of training movement data. Unlike the first set of training movement data, the second set of training movement data may be representative of eye movement of a person who is not reading the message presented at step 702, but rather of eye movement of a person merely scanning or glancing over the message.

At step 708, the EGM 10 compares the first set of training movement data to the second set of training movement data. The differences between the training movement data where the message is read and the training movement data where the message is merely scanned allows the EGM 10 to discern whether players are reading or scanning messages. The method 700 may be repeated multiple times in order to acquire more robust data sets regarding reading and scanning of messages.

This step of comparing may include, for example, comparing a reading pace of the person reading the message (based on the first set of training movement data) to a scanning speed of the person scanning the message (based on the second set of training data. Alternatively, or in addition, the step of comparing may include comparing the amount of time the person reading the message spends with their gaze fixed on individual words in the message to the amount of time the person scanning the message spends on traversing the message with their gaze. Of course, other methods for comparing the first and second set of training movement data are also considered.

In some embodiments, the at least one camera, and the display device 12 (and/or the secondary display device 14) may be calibrated. Calibration of the at least one camera and the display devices 12, 14 may be desirable because the eyes of each player using the electronic gaming machine may be physically different, such as the shape and location of the player's eyes, and the capability for each player to see. Each player may also stand at a different position relative to the EGM 10.

The at least one camera may be calibrated by the EGM 10 by detecting the movement of the player's eyes. In some embodiments, the display controller 52 may control the display devices 12, 14 to display one or more calibration symbols. There may be one calibration symbol that appears on the display devices 12, 14 at one time, or more than one calibration symbol may appear on the display devices 12, 14 at one time. The player may be prompted by text or by a noise to direct their gaze to one or more of the calibration symbols. The at least one camera may monitor the gaze of the player looking at the one or more calibration symbols and a distance of the player's eyes relative to the electronic gaming machine to collect calibration data. Based on the gaze corresponding to the player looking at different calibration symbols, the at least one camera may record player movement data associated with how the player's eyes rotate to look from one position on the display devices 12, 14 to a second position on the display devices 12, 14. The EGM 10 may calibrate the at least one camera based on the calibration data.

Figure 8:
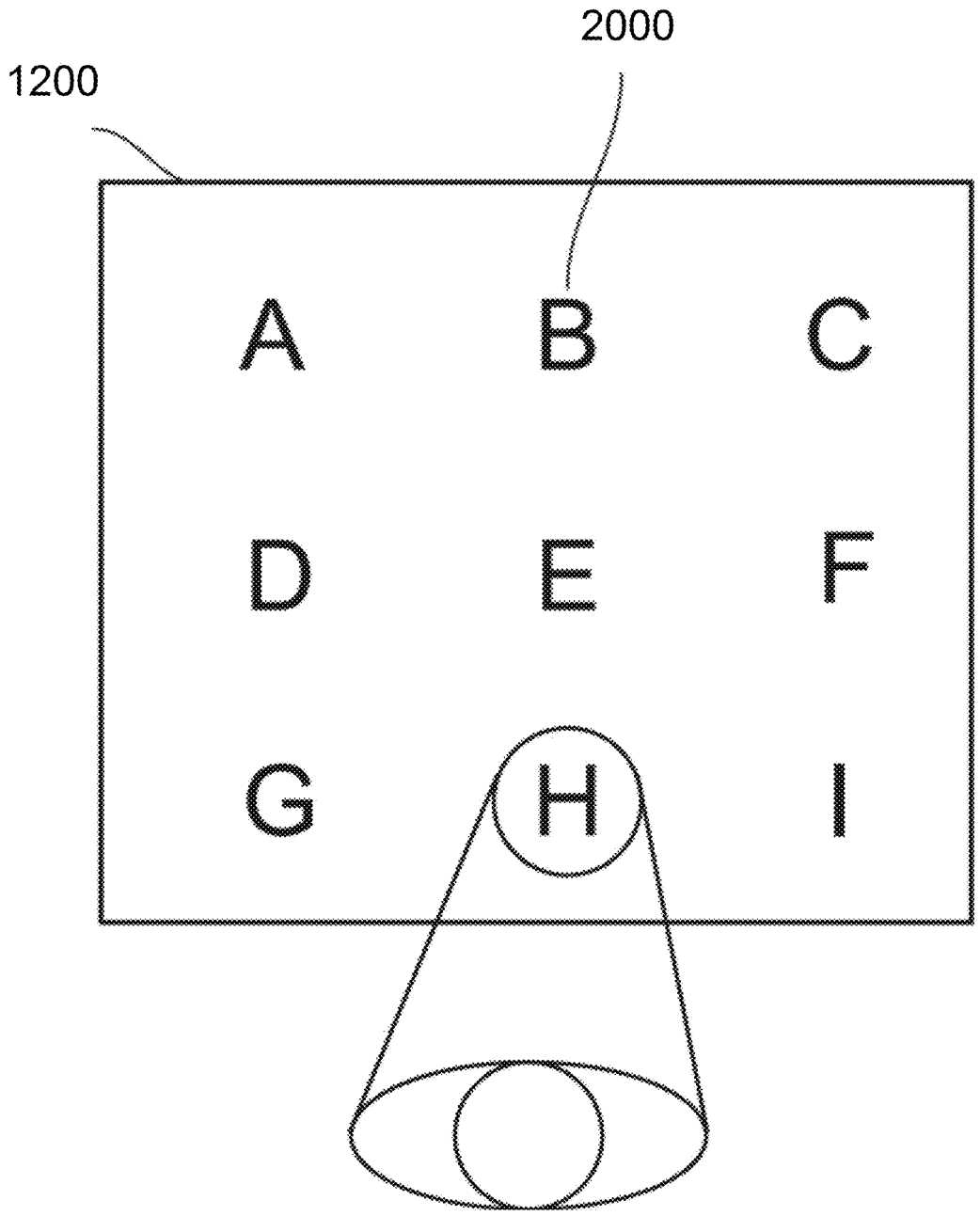
FIG. 8 illustrates a display having a plurality of calibration symbols.

For example, as shown in FIG. 8, before the player plays the interactive game, the EGM 10 may notify the player that the at least one camera and the display devices 12, 14 may be calibrated. The display controller 52 may cause the viewing area 1200 to display nine calibration symbols 2000. In FIG. 8, the calibration symbols 2000 are the letters "A" through "I", but the calibration symbols 2000 may be any other symbols. The calibration symbols 2000 may be located on any portion of the display devices 12, 14. The player may be prompted to look at the nine calibration symbols 2000 in a certain order. The at least one camera may monitor the gaze of the player looking at the nine calibration symbols 2000 and the distance of the player's eyes relative to the electronic gaming machine to collect the calibration data. When the at least one camera collects player movement data in real time, the EGM 10 may compare the player movement data with the calibration data in real time to determine the angle at which that the player's eyes are looking.

The display controller 52 may calibrate the display devices 12, 14 using the graphics controller based on the calibration data collected by the at least one camera. The at least one camera may monitor the gaze of the player to collect calibration data as described herein. The display controller 52 may calibrate the display devices 12, 14 using the graphics processor to display a certain resolution on the display devices 12, 14.

Figure 9:
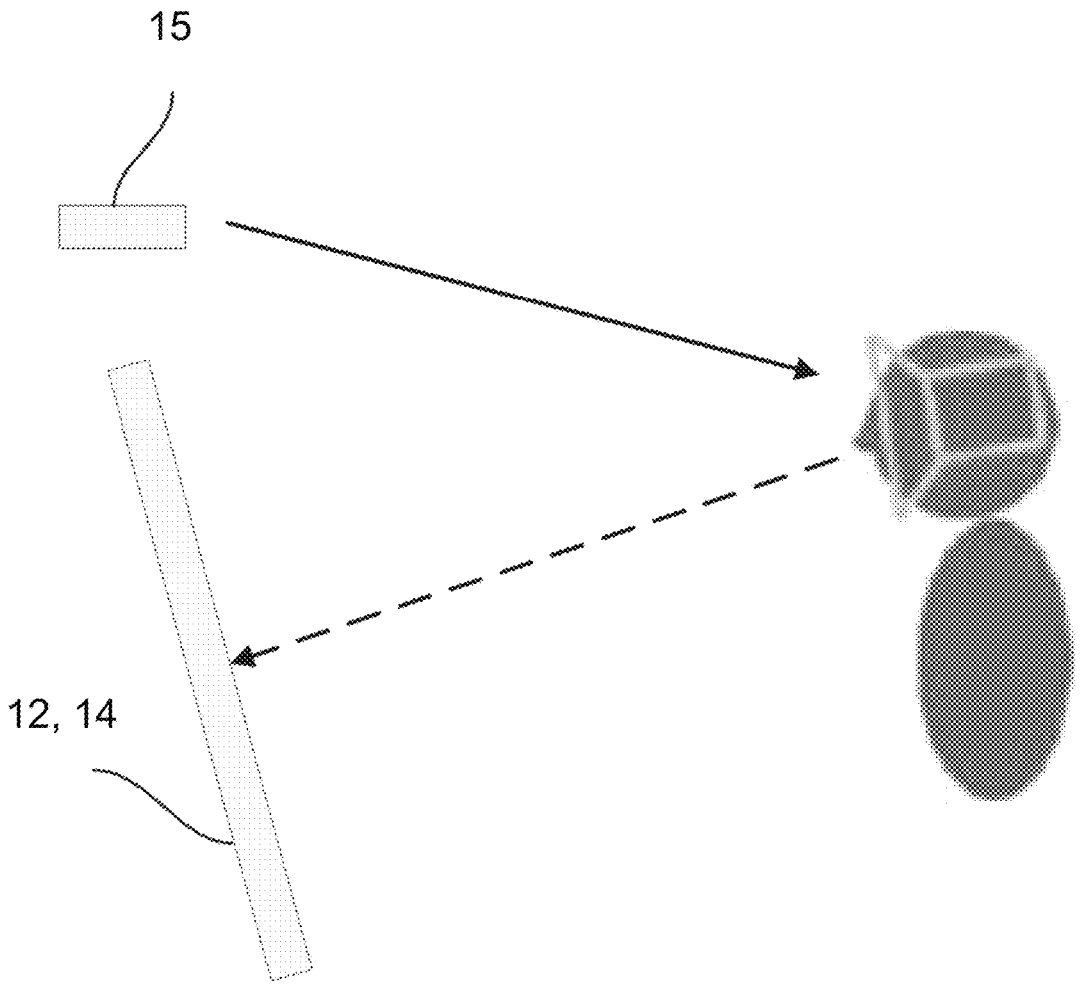
FIG. 9 illustrates a camera for monitoring a position of a player's eyes relative to an electronic gaming machine.

In some embodiments, the EGM 10 may determine the location of the gaze relative to the viewing area 1200 based on the position of the player's eyes relative to the electronic gaming machine and an angle of the player's eyes. As shown in FIG. 9, the at least one camera, which may be the camera 15, may monitor the position of the player's eyes relative to the electronic gaming machine, and may also monitor the angle of the player's eyes to collect display mapping data. The angle of the player's eyes may be determined based on the calibration of the at least one camera described herein. The angle of the player's eyes may define the focus of the gaze, which may be a line of sight relative to the display devices 12, 14. Based on the position of the player's eyes relative to the electronic gaming machine and an angle of the player's eyes or the line of sight relative to the display devices 12, 14, the EGM 10 may be configured to determine the direction of an array projecting from the player's eyes. The EGM 10 may determine where the array intersects with the display devices 12, 14, and may determine where the gaze of the player is focused on the display devices 12, 14. The EGM 10 may identify coordinates on the display devices 12, 14 corresponding to the player movement data and may map the coordinates to the viewing area 1200 to determine the gaze of the player relative to the viewing area 1200. In some embodiments, the gaze of the player may be expressed in three dimensions, depending on whether the interactive game is a two-dimensional game or a three-dimensional game.

While playing an interactive game on the EGM 10, the eyes of a player may move suddenly without the player being conscious of the movement. The eyes of the player may demonstrate subconscious, quick, and short movements, even if the player is not actively controlling their eyes to move in this manner. These subconscious, quick, and short eye movements may affect the determination of the EGM 10 of the gaze of the player based on the player movement data. Accurate processing of the player movement data related to these subconscious, quick, and short eye movements may result in detecting the location of the gaze of the player representative of eye twitching or erratic eye movements not reflective of the player's intended gaze, and may be distracting to the player. It may be useful for the player movement data to be filtered to not reflect these quick and short eye movements, for example, so the determination of the gaze of the player relative to the display units 12, 14 by the EGM 10 reflects the intended gaze of the player. It may also be useful for the portion of the player movement data representative of the subconscious, quick, and short eye movements to have less determinative effect on the determined location of the gaze of the player. In some embodiments, the EGM 10 may define a filter movement threshold, wherein the EGM 10, prior to determining a location of the gaze of the player relative to the display units 12, 14 using the player movement data collected by the at least one camera and updating the rendering of the display units 12, 14, determines that the player gaze meets the filter movement threshold.

As discussed supra, the at least one camera may collect player movement data. The EGM 10 may process the player movement data to correspond with a location on the viewing area 1200. The EGM 10 may determine where the player is looking at on the viewing area 1200 based on a certain number of previously recorded player movement data, for example, by tracking the last ten gaze positions to average out where on the viewing area 1200 the player is looking. The EGM 10 may limit the amount of previously recorded player movement data that is used to determine where on the viewing area 1200 the player is looking. The EGM 10 may filter out, or "smooth out", player movement data outside of the pre-determined filter movement threshold, which may represent sudden and subconscious eye movement. The EGM 10 may map the gaze of the player to the viewing area 1200 using at least a portion of the filtered player movement data to determine the location of the viewing area 1200 at which the player is looking, in order to map the player's gaze to the viewing area 1200. As another example, the EGM 10 may delay in processing the player movement data associated with subconscious, quick, and short eye movements, so the detected location of the gaze of the player does not represent twitching or sudden unconscious eye movements. Large eye motions may also be associated with more delay in processing and more smoothing. In some embodiments, the EGM 10 may partition the player movement data associated with large eye motions into data representative of shorter eye motions. The EGM 10 may analyze the player movement data to determine which player movement data is associated with subconscious eye movement or with conscious eye movement based on a filter movement threshold, a time threshold, movement threshold, or any combination thereof. Player movement data associated with quick eye movements over a certain period of time may be determined by the EGM 10 to be subconscious eye movement. The EGM 10 may delay in processing this portion of player movement data so the detected location of the eye gaze of the player may be stable and may not distract the player, or the EGM 10 may filter out this player movement data and not process it. Player movement data associated with large eye movements over a certain period of time may be determined by the EGM 10 to be the player losing focus or being distracted. The EGM 10 may similarly delay in processing this portion of player movement data or not process this portion of player movement data. In some embodiments, EGM 10 may filter out, or "smooth out" player movement data that may exceed the filter movement threshold, in the manner described herein.

The locations where EGM 10 may be used may have a variety of lighting conditions. For example, EGM 10 may be used in a restaurant, a hotel lobby, an airport, and a casino. It may be brighter in some locations and darker in other locations, or the light quality may fluctuate from brightness to darkness. In some embodiments, EGM 10 may include an infrared light source that illuminates the player. The infrared light sources may not interfere with the eyes of the player. In some embodiments, the at least one camera may be an infrared camera. The infrared camera may collect player movement data without being affected by the lighting conditions of the locations where EGM 10 may be used. In some embodiments, EGM 10 may have a plurality of light sources providing a plurality of spectra of light, and the at least one camera may be a plurality of cameras configured to detect a plurality of spectra of light, so the at least one camera may collect player movement data without being affected by the lighting conditions of the locations where EGM 10 may be used.

A player that plays an interactive game using EGM 10 may be wearing glasses. The glasses of the player may cause refractions and/or reflections of the light that illuminates the player. This may affect the at least one camera while it monitors the gaze, eye gesture, and/or movement of the player. Glasses that comprise an infrared filter may also interfere with or affect the at least one camera while it monitors the gaze, eye gesture, and/or movement of the player. EGM 10 may recognize that the player may be wearing glasses. For example, as the interactive game commences, display controller 52 may display on display devices 12, 14 using graphics processor a question asking the player if he or she is wearing glasses. The player may provide input indicating whether he or she is wearing glasses, such as, but not limited to, with an audio command, touch command, or with the player's gaze. As other example, the EGM 10 may recognize, based on processing the player movement data from the at least one camera, that the light illuminating the player may be refracted, and may determine that the player is wearing glasses. When EGM 10 recognizes that the player may be wearing glasses, the EGM 10 may perform additional and/or more stringent filtering functions as described herein to compromise for the player's use of glasses and to accommodate the refractions of the light that illuminates the player. For example, the filter movement threshold may be set to be higher for players who wear glasses.

The game may be played on a standalone video gaming machine, a gaming console, on a general purpose computer connected to the Internet, on a smart phone, or using any other type of gaming device. The video gaming system may include multiplayer gaming features.

Figure 10:
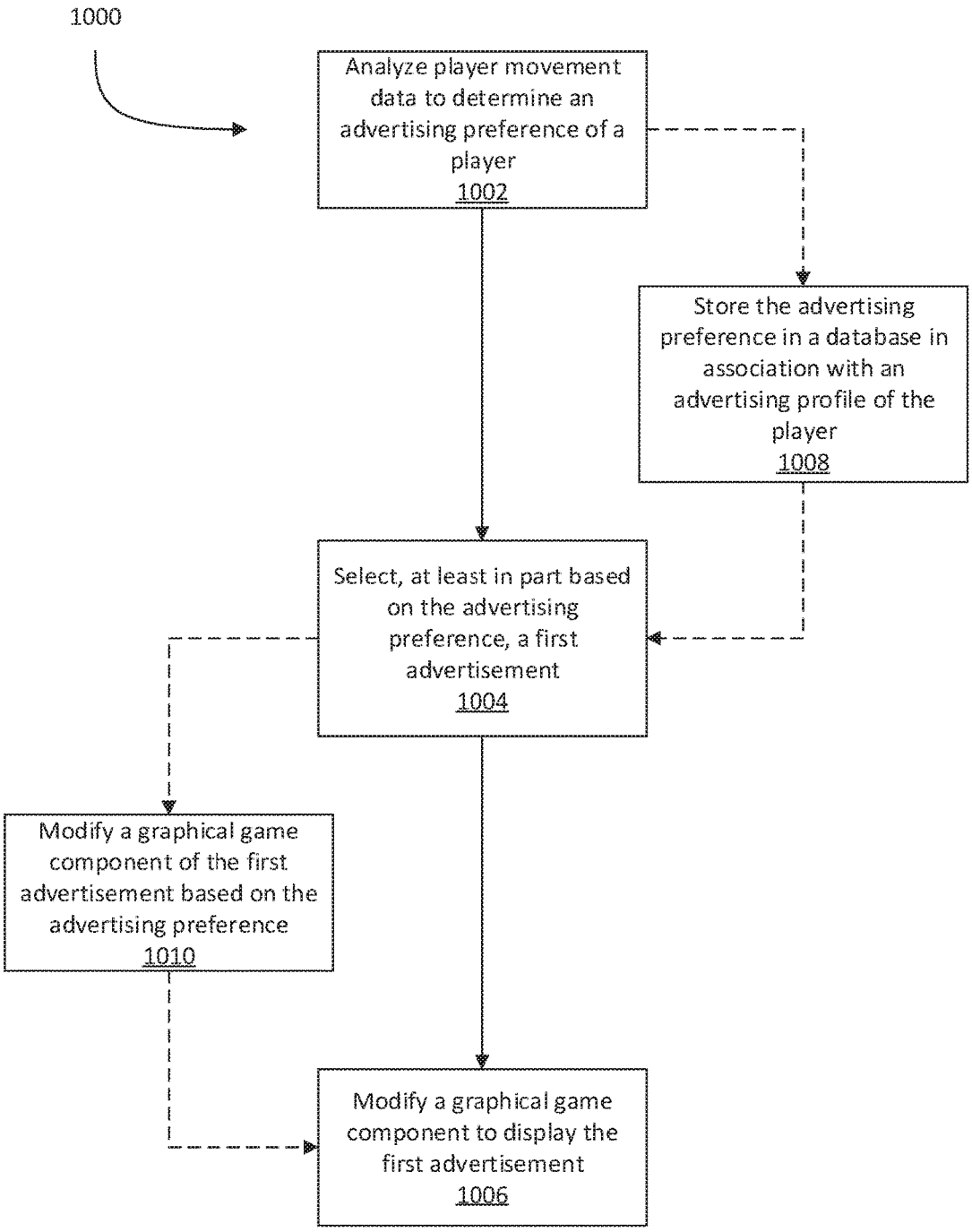
FIG. 10 illustrates a flowchart diagram of an exemplary method according to an embodiment.

FIG. 10 illustrates a flowchart diagram of an exemplary method 1000 according to an embodiment. The method 1000, which may be performed at least in part by an electronic gaming machine, comprises analyzing player movement data to determine an advertising preference of a player (Block 1002). The method 1000 further comprises selecting, at least in part based on the advertising preference, a first advertisement (Block 1004). The method 1000 further comprises modifying a graphical game component to display the first advertisement (Block 1006). The method 1000 may also comprise storing the advertising preference in a database in association with an advertising profile of the player (Block 1008). The method 1000 may also comprise modifying a graphical game component of the first advertisement based on the advertising preference (Block 1010).

The game may be played on a social media platform, such as Facebook™. The video gaming computer system may also connect to a one or more social media platforms, for example to include social features. For example, the video gaming computer system may enable the posting of results as part of social feeds. In some applications, no monetary award is granted for wins, such as in some on-line games. For playing on social media platforms, non-monetary credits may be used for bets and an award may comprise similar non-monetary credits that can be used for further play or to have access to bonus features of a game. All processing may be performed remotely, such as by a server, while a player interface (computer, smart phone, etc.) displays the game to the player.

The functionality described herein may also be accessed as an Internet service, for example by accessing the functions or features described from any manner of computer device, by the computer device accessing a server computer, a server farm or cloud service configured to implement said functions or features.

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. A processor may be implemented using circuitry in any suitable format.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including an EGM, A Web TV, a Personal Digital Assistant (PDA), a smart phone, a tablet or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards and pointing devices, such as mice, touch pads, and digitizing tablets. As another example, a computer may receive input information through speech recognition or in other audible formats.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the enhancements to game components may be embodied as a tangible, non-transitory computer readable storage medium (or multiple computer readable storage media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other non-transitory, tangible computer-readable storage media) encoded with one or more programs that, when executed on one or more computers or other processors, perform methods that implement the various embodiments discussed above. The computer readable medium or media can be transportable, such that the program or programs stored thereon can be loaded onto one or more different computers or other processors to implement various aspects as discussed above. As used herein, the term "non-transitory computer-readable storage medium" encompasses only a computer-readable medium that can be considered to be a manufacture (i.e., article of manufacture) or a machine.

The terms "program" or "software" are used herein in a generic sense to refer to any type of computer code or set of computer-executable instructions that can be employed to program a computer or other processor to implement various aspects of the present invention as discussed above. Additionally, it should be appreciated that according to one aspect of this embodiment, one or more computer programs that when executed perform methods as described herein need not reside on a single computer or processor, but may be distributed in a modular fashion amongst a number of different computers or processors to implement various aspects.

Computer-executable instructions may be in many forms, such as program modules, executed by one or more computers or other devices. Generally, program modules include routines, programs, objects, components, data structures, etc., that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Various aspects of the present game enhancements may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments. While particular embodiments have been shown and described, it will be obvious to those skilled in the art that changes and modifications may be made without departing from this invention in its broader aspects. The appended claims are to encompass within their scope all such changes and modifications.

The invention claimed is:

1. An electronic gaming machine, comprising:

a data storage unit that stores game data for a game played by a player, the game comprising wagering and payout elements;

a display unit that displays, via a graphical user interface, graphical game components of the game in accordance with a set of game rules for the game, wherein the graphical game components comprise visible objects rendered on the graphical user interface in accordance with the set of game rules and viewable by the player on the graphical user interface;

a payment mechanism that provides payment to the player based on the game;

a data capture unit that collects player movement data representative of movement of an eye of the player in response to movement of the graphical game components rendered on the graphical user interface; and a processing device comprising a processor circuit and a memory, wherein the memory comprises machine readable program code that causes the processor circuit to:

determine an advertising preference of the player based on the player movement data;

select, at least in part based on the advertising preference, a first advertisement; and modify one graphical game component of the graphical game components already presented via the graphical user interface, to display the first advertisement on a surface of the one graphical game component that did not include the first advertisement prior to modification.

2. The electronic gaming machine of claim 1, wherein the processing device further causes the advertising preference of the player to be stored in a database, the advertising preference being stored in association with an advertising profile of the player.

3. The electronic gaming machine of claim 1, wherein the data capture unit comprises a camera that captures an image of the player, the player movement data comprising the image.

4. The electronic gaming machine of claim 1, wherein the data capture unit comprises a camera that detects whether the player is occupying the electronic gaming machine.

5. The electronic gaming machine of claim 1, wherein the display unit comprises a three-dimensional (3D) display that displays at least some of the graphical game components as 3D graphical game components.

6. The electronic gaming machine of claim 5, wherein the 3D display is an auto stereoscopic 3D display.

7. The electronic gaming machine of claim 5, wherein the machine readable program code further causes the processor circuit to:

determine, based on the player movement data, a gaze point of the player relative to the 3D display in real time, and modify a view of the 3D graphical game components based on the gaze point of the player relative to the 3D display in real time.

8. The electronic gaming machine of claim 7, wherein determining the gaze point of the player relative to the 3D display in real time comprises determining a foveal area surrounding the gaze point, and wherein modifying the view of the 3D graphical game components based on the gaze point of the player relative to the 3D display in real time comprises modifying one of the 3D graphical game components within the foveal area.

9. The electronic gaming machine of claim 1, wherein the machine readable program code further causes the processor circuit to:

determine a player account associated with the player; and prior to the data capture unit collecting the player movement data, determining whether the player account includes a feature comprising the tracking of the player movement data, wherein the data capture unit collects player movement data only in response to determining that the player account includes the feature.

10. The electronic gaming machine of claim 1, wherein the machine readable program code further causes the processor circuit to:

determine a plurality of movements of the player based on the player movement data;

determine, for each movement of the plurality of movements, whether the movement meets a filter movement threshold representative of conscious movement of the eye of the user; and exclude data corresponding to movements that do not meet the filter movement threshold from the player movement data.

11. A method comprising:

displaying, via a graphical user interface of a display unit, graphical game components of a game in accordance with game data comprising a set of game rules for the game stored on a data storage unit of an electronic gaming system, the graphical game components comprising visible objects rendered on the graphical user interface in accordance with the set of game rules and viewable by a player on the graphical user interface;

collecting, via a data capture unit, player movement data representative of movement of an eye of the player in response to movement of the graphical game components rendered on the graphical user interface;

determining, by a processing device, an advertising preference of the player based on the player movement data;

selecting, by the processing device, a first advertisement at least in part based on the advertising preference; and modifying, by the processing device, one graphical game component of the graphical game components already presented via the graphical user interface to display the first advertisement on a surface of the one graphical game component that did not include the first advertisement prior to the modification.

12. The method of claim 11, wherein the display unit comprises a three-dimensional (3D) display, and wherein displaying the graphical game components comprises displaying at least some of the graphical game components as 3D graphical game components.

13. The method of claim 12, further comprising:

determining, by the processing device based on the player movement data, a gaze point of the player relative to the 3D display in real time, and modifying a view of the 3D graphical game components based on the gaze point of the player relative to the 3D display in real time.

14. A non-transitory computer-readable storage medium comprising machine readable instructions that are executable by a processing circuit to direct the processing circuit to perform a method comprising:

displaying, via a graphical user interface, graphical game components of a game in accordance with game data comprising a set of game rules for the game stored on a data storage unit of an electronic gaming system, the graphical game components comprising visible objects rendered on the graphical user interface in accordance with the set of game rules and viewable by a player on the graphical user interface;

collecting, via a data capture unit, player movement data representative of movement of an eye of the player in response to movement of the graphical game components rendered on the graphical user interface;

determining, by the processing circuit, an advertising preference of the player based on the player movement data;

selecting, by the processing device, a first advertisement at least in part based on the advertising preference; and modifying, by the processing circuit, one graphical game component of the graphical game components already presented via the graphical user interface to display the first advertisement on a surface of the one graphical game component that did not include the first advertisement prior to modification.

* * * * *